US006594631B1

(12) United States Patent
Cho et al.

(10) Patent No.: US 6,594,631 B1
(45) Date of Patent: Jul. 15, 2003

(54) METHOD FOR FORMING PHONEME DATA AND VOICE SYNTHESIZING APPARATUS UTILIZING A LINEAR PREDICTIVE CODING DISTORTION

(75) Inventors: Shisei Cho, Tsurugashima (JP); Katsumi Amano, Tsurugashima (JP); Hiroyuki Ishihara, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 229 days.

(21) Appl. No.: 09/657,163

(22) Filed: Sep. 7, 2000

(30) Foreign Application Priority Data

Sep. 8, 1999 (JP) ..... 11-254312

(51) Int. Cl.[7] ..... G10L 21/02
(52) U.S. Cl. ..... 704/268; 704/262
(58) Field of Search ..... 704/258, 262, 704/269

(56) References Cited

U.S. PATENT DOCUMENTS

| | | | | |
|---|---|---|---|---|
| 5,220,629 A | * | 6/1993 | Kosaka et al. | 704/260 |
| 5,537,647 A | * | 7/1996 | Hermansky et al. | 704/211 |
| 5,581,652 A | * | 12/1996 | Abe et al. | 704/222 |
| 5,621,854 A | * | 4/1997 | Hollier | 704/200.1 |
| 5,633,984 A | * | 5/1997 | Aso et al. | 704/260 |
| 5,845,047 A | * | 12/1998 | Fukada et al. | 704/268 |
| 6,125,346 A | * | 9/2000 | Nishimura et al. | 704/258 |

OTHER PUBLICATIONS

Minami et al, "Adaptation Method Based on HMM Composition and EM Algorithm", ICASSP–96, pp 327–330.*

Morishima et al, "Phonetically Adaptive Cepstrum Mean Normalization for Acoustic Mismatch Compensation", IEEE Workshop on Automatic Speech Recognition and Understanding, pp 436–441.*

Applebaum et al, "A Phoneme–similarity based ASR front–end", Acoustic, Speech, and Signal Processing, 1996, pp 33–36.*

* cited by examiner

*Primary Examiner*—Doris H. To
*Assistant Examiner*—Michael N. Opsasnick
(74) *Attorney, Agent, or Firm*—Morgan, Lewis & Bockius LLP

(57) ABSTRACT

A method for forming phoneme data and a voice synthesizing apparatus for phoneme data in the voice synthesizing apparatus is provided. In this method and apparatus, an LPC coefficient is obtained for every phoneme and is set to temporary phoneme data and a first LPC Cepstrum based on the LPC coefficient is obtained. A second LPC Cepstrum is obtained based on each voice waveform signal which has been synthesized and generated by the voice synthesizing apparatus while the pitch frequency is changed step by step with a filter characteristic of the voice synthesizing apparatus being set to a filter characteristic according to the temporary phoneme data. Further, an error between the first and second LPC Cepstrums is obtained as an LPC Cepstrum distortion. Each phoneme in the phoneme group belonging to the same phoneme name in each of the phonemes is classified into a plurality of groups every frame length. The optimum phoneme is selected based on the LPC Cepstrum distortion every group from this group. The temporary phoneme data corresponding to this phoneme is used as final phoneme data.

5 Claims, 10 Drawing Sheets

FIG. 8

| PITCH FREQUENCY | LPC CEPSTRUM |
|---|---|
| $K_{MIN}$ | $C^{(2)}_{n1}$ |
| $K_{MIN} + \alpha$ | $C^{(2)}_{n2}$ |
| $K_{MIN} + 2\alpha$ | $C^{(2)}_{n3}$ |
| $K_{MIN} + 3\alpha$ | $C^{(2)}_{n4}$ |
| ⋮ | ⋮ |
| $K_{MAX}$ | $C^{(2)}_{nR}$ |

FIG. 9

| PHONEME NO. | CHARACTER TRAIN | FRAME LENGH |
|---|---|---|
| 1 | もくてきち | 15 |
| 2 | もよおしもの | 13 |
| 3 | もより | 12 |
| 4 | もくひょう | 10 |
| 5 | もうしこみ | 7 |
| 6 | もにたー | 12 |
| 7 | ものがたり | 13 |
| 8 | もざいく | 8 |
| 9 | もくせい | 9 |
| 10 | もぐる | 12 |
| 11 | もすくわ | 15 |

FIG.10

| GROUP | LENGTH OF REPRESENTATIVE PHONEME | RANGE OF PHONEME LENGTH | CANDIDATES OF PHONEME (PHONEME NO.) |
|---|---|---|---|
| 1 | 15 | 15 ~ 11 | 1、2、3、6、7、10、11 |
| 2 | 14 | 14 ~ 10 | 2、3、4、6、7、10 |
| 3 | 13 | 13 ~ 10 | 2、3、4、6、7、10 |
| 4 | 12 | 12 ~ 9 | 3、4、6、9、10 |
| 5 | 11 | 11 ~ 8 | 4、8、9 |
| 6 | 10 | 10 ~ 7 | 4、5、8、9 |

METHOD FOR FORMING PHONEME DATA AND VOICE SYNTHESIZING APPARATUS UTILIZING A LINEAR PREDICTIVE CODING DISTORTION

BACKGROUND OF THE INVENTION

1. Field of the Invention

The invention relates to a voice synthesis for artificially forming a voice waveform signal.

2. Description of Related Art

A voice waveform by a natural voice can be expressed by coupling, in a time sequential manner, basic units in which phonemes, namely, one or two vowels (hereinafter, each referred to as V) and one or two consonants (hereinafter, each referred to as C) are connected in such a manner as "CV", "CVC", or "VCV".

Therefore, if a character string in a document is replaced with a phoneme train in which phonemes are coupled as mentioned above and a sound corresponding to each phoneme in the phoneme train is sequentially formed, a desired document (text) can be read out by an artificial voice.

A text voice synthesizing apparatus is an apparatus that can provide the function described above and a typical voice synthesizing apparatus comprises a text analysis processing unit for forming an intermediate language character string signal obtained by inserting information such as accent, phrase, or the like into a supplied text, and a voice synthesis processing unit for synthesizing a voice waveform signal corresponding to the intermediate language character string signal.

The voice synthesis processing unit comprises a sound source module for generating a pulse signal corresponding to a voiced sound and a noise signal corresponding to a voiceless sound as a basic sound, and a voice route filter for generating a voice waveform signal by performing a filtering process to the basic sound. The voice synthesis processing unit is further provided with a phoneme data memory in which filter coefficients, of the voice route filter obtained by converting voice samples at the time when a voice sample target person actually reads out a text, are stored as phoneme data.

The voice synthesis processing unit is operative to divide the intermediate language character string signal supplied from the text analysis processing unit into a plurality of phonemes, to read out the phoneme data corresponding to each phoneme from the phoneme data memory, and to use it as filter coefficients of the voice route filter.

With this construction, the supplied text is converted into the voice waveform signal having a voice tone corresponding to a frequency (hereinafter, referred to as a pitch frequency) of a pulse signal indicative of the basic sound.

However, there remains an influence by the pitch frequency of the voice which has been actually read out by the voice sample target person not a little in the phoneme data which is stored in the phoneme data memory. On the other hand, the pitch frequency of the voice waveform signal to be synthesized hardly coincides with the pitch frequency of the voice which has been actually read out by the voice sample target person.

Therefore, a problem exists that a frequency caused by the influence of the pitch frequency component, which is included in the phoneme data at the time of voice synthesis is not perfectly removed, and such a frequency and the pitch frequency of the voice waveform signal to be synthesized mutually interfere and as a result an unnatural synthetic voice is produced.

OBJECTS AND SUMMARY OF THE INVENTION

It is an object of the invention to provide a phoneme data forming method for use in a voice synthesizing apparatus in which a natural synthetic voice can be obtained irrespective of a pitch frequency of a voice waveform signal to be synthesized and generated and provide a voice synthesizing apparatus.

According to one aspect of the invention, there is provided a phoneme data forming method for use in a voice synthesizing apparatus that obtains a voice waveform signal by effecting a filtering-process to a frequency signal by using filter characteristics according to the phoneme data, comprising the steps of: separating each of input voice samples into a plurality of phonemes; obtaining a linear predictive coding coefficient by performing a linear predictive coding analysis to each of said plurality of phonemes, setting it as temporary phoneme data, obtaining a linear predictive coding Cepstrum based on the linear predictive coding coefficient, and setting it as a first linear predictive coding Cepstrum; obtaining a linear predictive coding Cepstrum by performing the linear predictive coding analysis to each of the voice waveform signals obtained by the voice synthesizing apparatus while changing a frequency of the frequency signal step by step with a filter characteristic of the voice synthesizing apparatus being set to a filter characteristic according to the temporary phoneme data, and setting it as a second linear predictive coding Cepstrum; obtaining an error between the first linear predictive coding Cepstrum and the second linear predictive coding Cepstrum as a linear predictive coding Cepstrum distortion; classifying each phoneme in a phoneme group belonging to a same phoneme name in each of the phonemes into a plurality of groups every phoneme length; and selecting the phoneme of the smallest linear predictive coding Cepstrum distortion from the group every group and using the temporary phoneme data corresponding to the selected phoneme as the phoneme data.

According to another aspect of the invention, there is provided a voice synthesizing apparatus comprising: a phoneme data memory in which a plurality of phoneme data corresponding to each of a plurality of phonemes has previously been stored; a sound source for generating frequency signals indicative of a voiced sound and a voiceless sound; and a voice route filter for obtaining a voice waveform signal by filtering-processing the frequency signal based on filter characteristics according to the phoneme data, wherein a linear predictive coding coefficient is obtained by performing a linear predictive coding analysis to the phoneme and set to temporary phoneme data, a linear predictive coding Cepstrum based on the linear predictive coding coefficient is obtained and set to a first linear predictive coding Cepstrum, filter characteristics of the voice synthesizing apparatus are set to filter characteristics according to the temporary phoneme data, when a frequency of the frequency signal is changed step by step, the linear predictive coding analysis is performed to each of the voice waveform signals at each of the frequencies obtained by the voice synthesizing apparatus, a linear predictive coding Cepstrum is obtained and set to a second linear predictive coding Cepstrum, an error between the first linear predictive coding Cepstrum and the second linear predictive coding Cepstrum is obtained as a linear predictive coding Cepstrum distortion, each phoneme in a phoneme group belonging to a same phoneme name in each of the phonemes is classified into a plurality of groups every phoneme length, and each of the phoneme data is the temporary phoneme data corresponding to the optimum phoneme selected from the group based on the linear predictive coding Cepstrum distortion.

BRIEF DESCRIPTION OF THE DRAWINGS

FIG. 8 is a diagram showing an LPC Cepstrum obtained every pitch frequency;

FIG. 9 is a diagram showing various phonemes corresponding to "mo"; and

FIG. 10 is a diagram showing an example in the case where the phoneme "mo" is grouped based on the method for forming phoneme data according to the invention.

DETAILED DESCRIPTION OF THE PREFERRED EMBODIMENT

Figure 1:
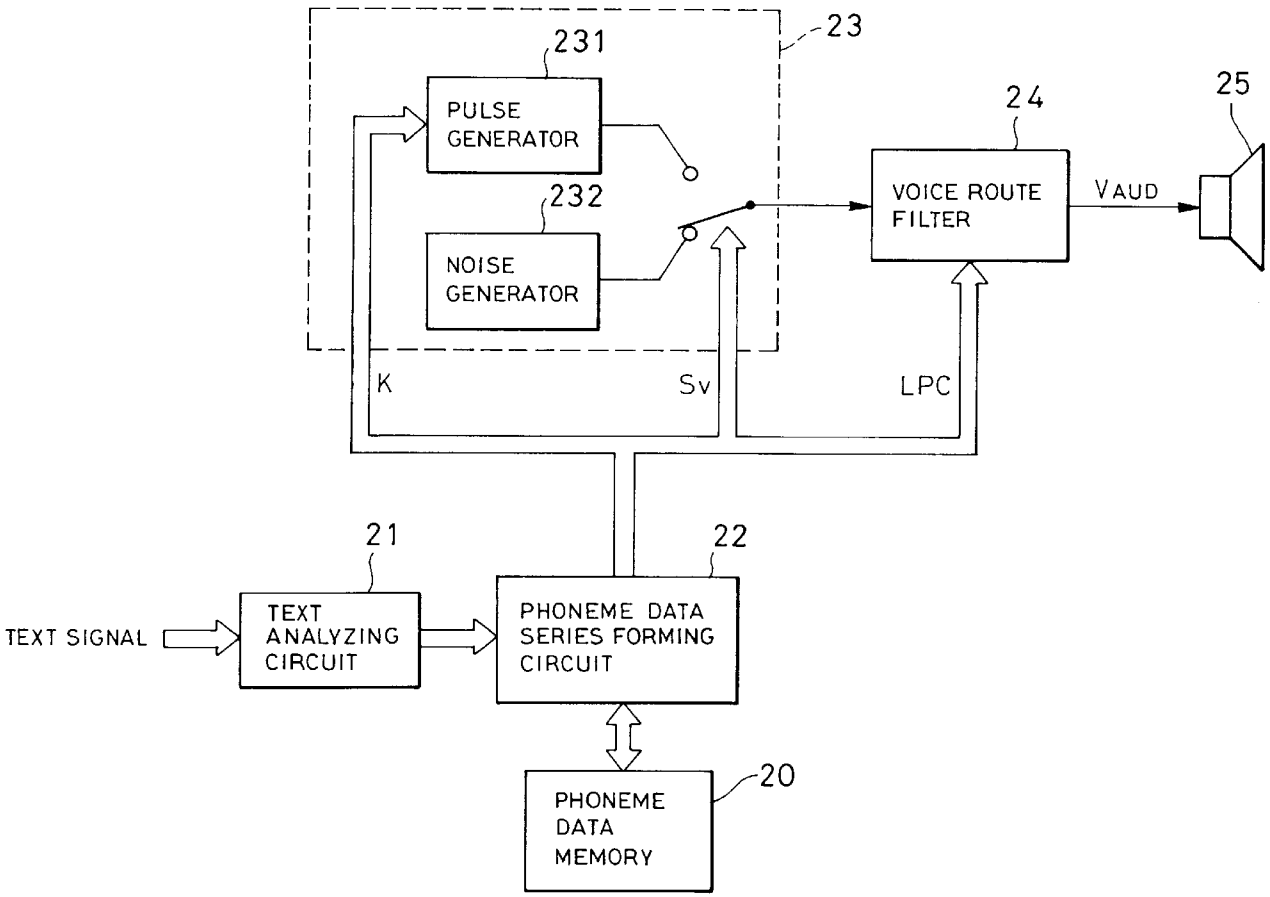
FIG. 1 is a diagram showing the structure of a text voice synthesizing apparatus in which stored phoneme data formed by a method for forming phoneme data according to the invention.

FIG. 1 is a diagram showing the structure of a text voice synthesizing apparatus in which stored phoneme data is formed by the method for forming phoneme data according to the invention.

In FIG. 1, a text analyzing circuit 21 forms an intermediate language character string signal obtained by inserting information such as accent, phrase, or the like that is peculiar to each language into a character string based on a supplied text signal and supplies it to a phoneme data series forming circuit 22.

The phoneme data series forming circuit 22 divides the intermediate language character string signal into phonemes "VCV" and sequentially reads out the phoneme data corresponding to each of the phonemes from a phoneme data memory 20. Based on the phoneme data read out from the phoneme data memory 20, the phoneme data series forming circuit 22 supplies a sound source selection signal $S_V$ indicative of a voiced sound or a voiceless, and a pitch frequency designation signal K to designate the sound source selection signal pitch frequency to a sound source module 23. The phoneme data series forming circuit 22 supplies phoneme data read out from the phoneme data memory 20, namely, LPC (Linear Predictive Coding) coefficients corresponding to voice spectrum envelope parameters to a voice route filter 24.

The sound source module 23 comprises a pulse generator 231 for generating an impulse signal of a frequency according to the pitch frequency designation signal K, and a noise generator 232 for generating a noise signal showing the voiceless sound. The sound source module 23 alternatively selects one of the pulse signal and the noise signal shown by the sound source selection signal $S_V$ supplied from the phoneme data series forming circuit 22 and, further, supplies the signal whose amplitude has been adjusted to the voice route filter 24.

The voice route filter 24 comprises an FIR (Finite Impulse Response) digital filter or the like. The voice route filter 24 uses the LPC coefficients showing a voice spectrum envelope supplied from the phoneme data series forming circuit 22 as filter coefficients and performs a filtering process to the impulse signal or noise signal supplied from the sound source module 23. The voice route filter 24 supplies the signal obtained by the filtering process as a voice waveform signal $V_{AUD}$ to a speaker 25. The speaker 25 generates an acoustic sound according to the voice waveform signal $V_{AUD}$.

By the construction as mentioned above, an acoustic sound corresponding to the read-out voice of the supplied text is generated from the speaker 25.

Figure 2:
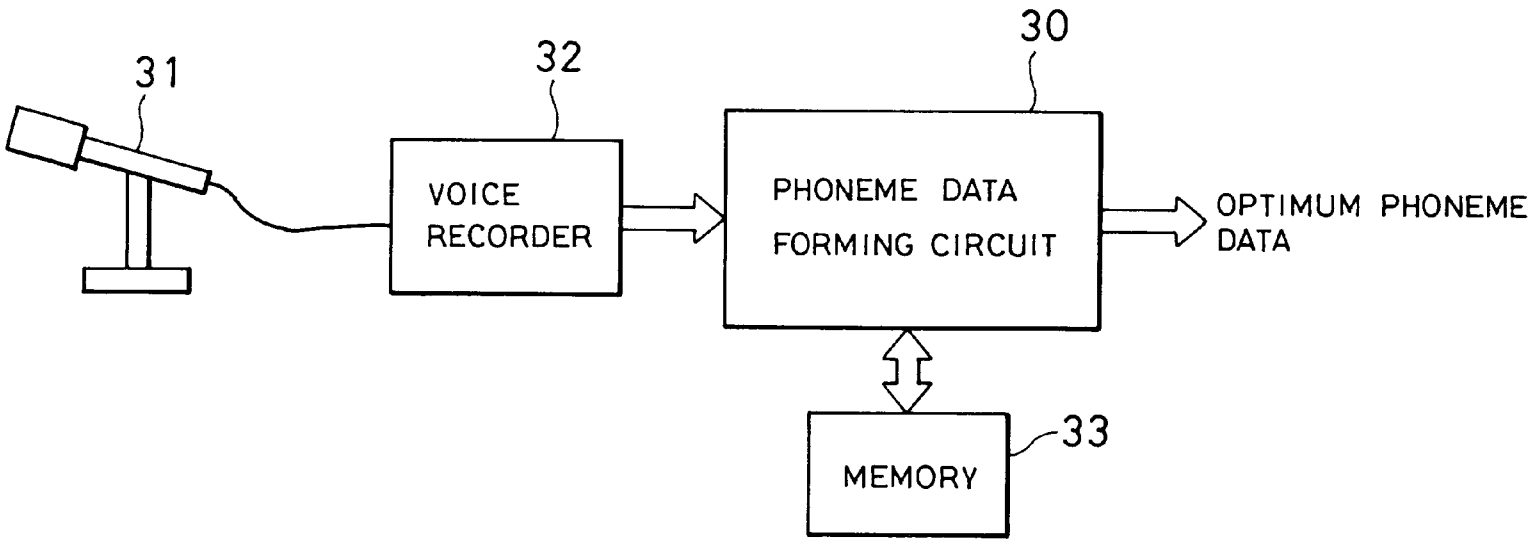
FIG. 2 is a diagram showing a system configuration for forming phoneme data.

FIG. 2 is a diagram showing a system configuration for forming the phoneme data to be stored in the phoneme data memory 20.

In FIG. 2, a voice recorder 32 records the actual voice of a voice sample target person collected by a microphone 31 so that the actual voice is acquired as voice samples. The voice recorder 32 reproduces each of the voice samples recorded as mentioned above and supplies the recorded voice sample to a phoneme data forming apparatus 30.

After each of the voice samples has been stored in a predetermined area in a memory 33, the phoneme data forming apparatus 30 executes various processes in accordance with a procedure which will be explained later, thereby forming the optimum phoneme data to be stored in the phoneme data memory 20.

Figure 3:
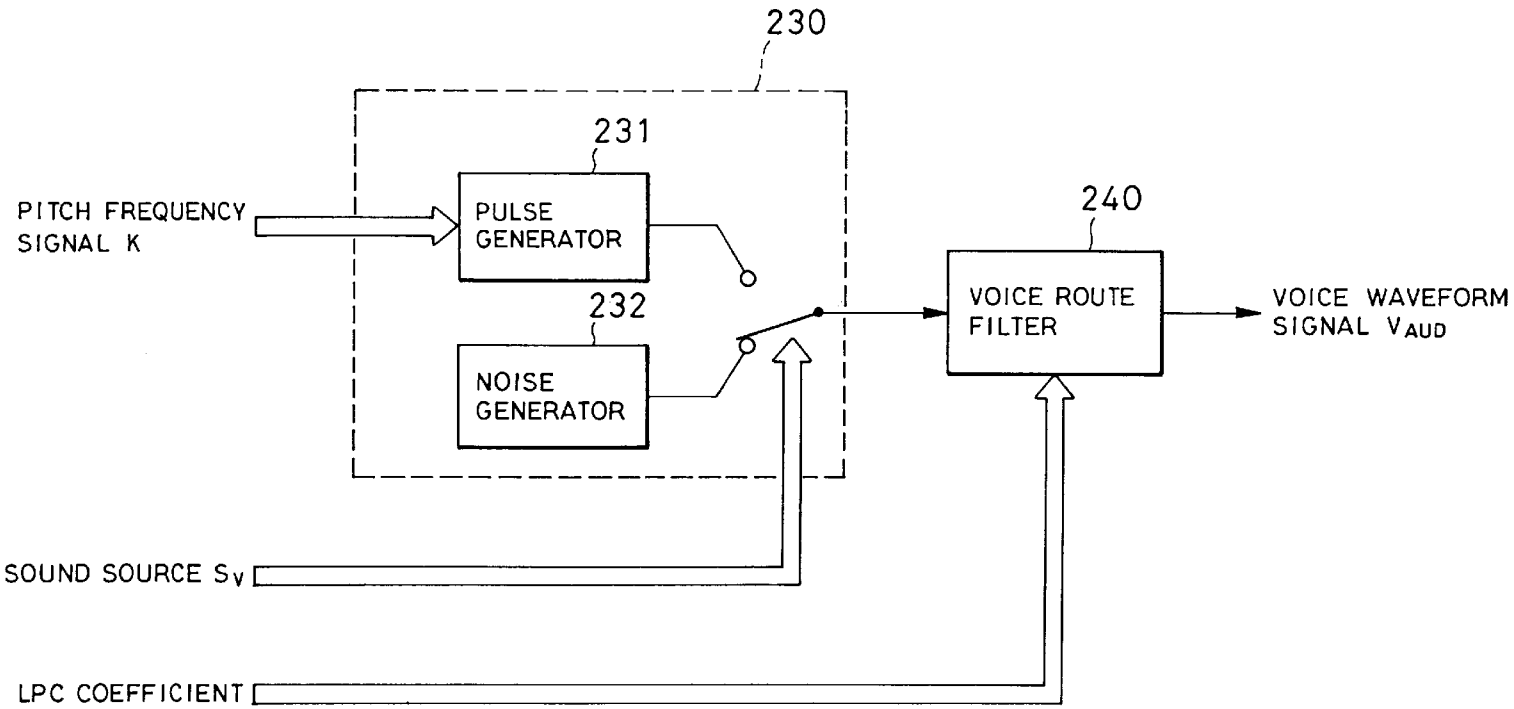
FIG. 3 is a diagram showing the structure of a voice waveform forming apparatus provided in a phoneme data forming apparatus 30.

It is assumed that a voice waveform forming apparatus having a construction as shown in FIG. 3 is provided in the phoneme data forming apparatus 30. The explanation of the operation of each of a sound source module 230 and a voice route filter 240 is omitted because it is substantially the same as that of each of the sound source module 23 and voice route filter 24 shown in FIG. 1.

Figure 4:
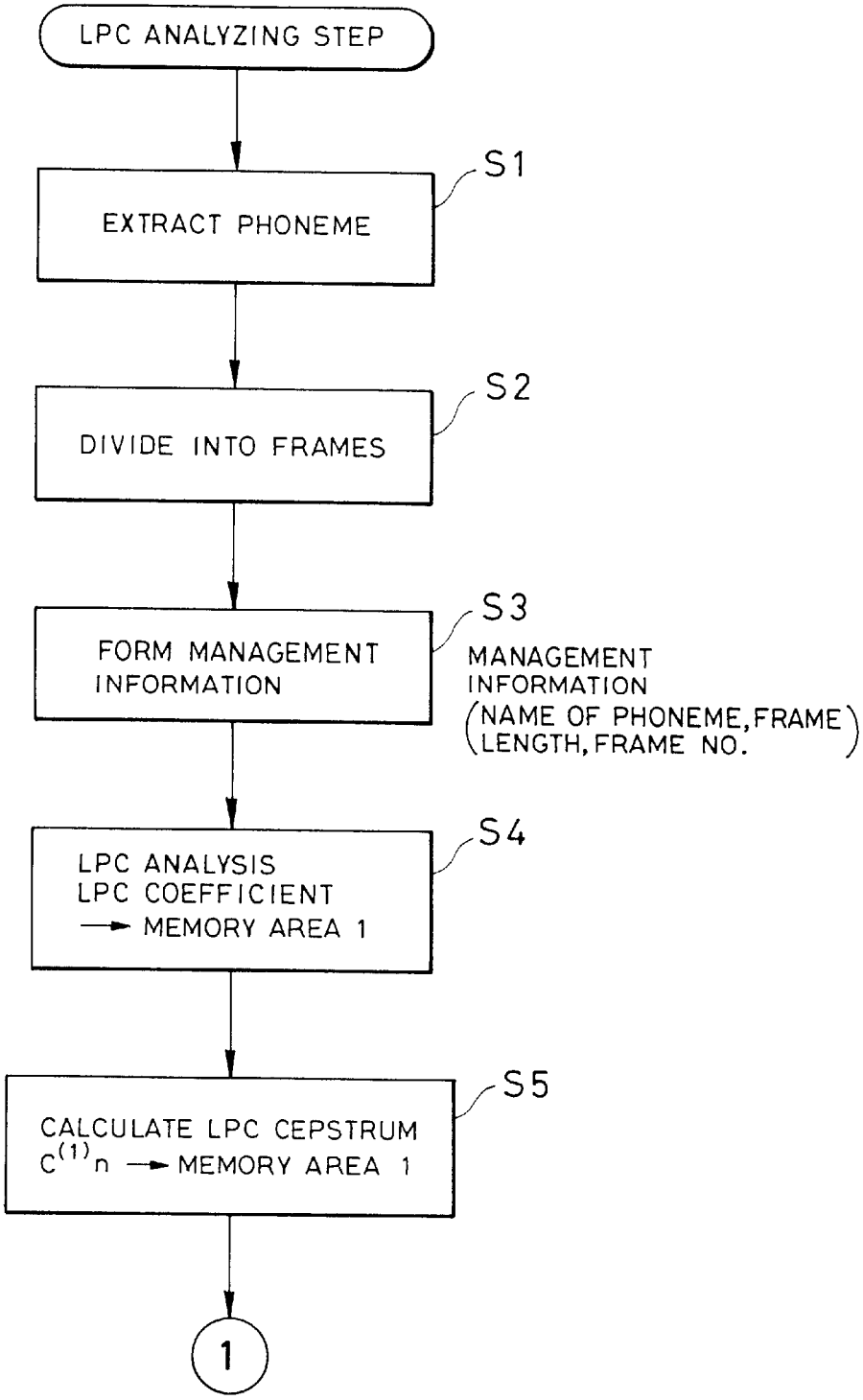
FIG. 4 is a diagram showing a procedure for forming optimum phoneme data based on the phoneme data forming method according to the invention.
Figure 5:
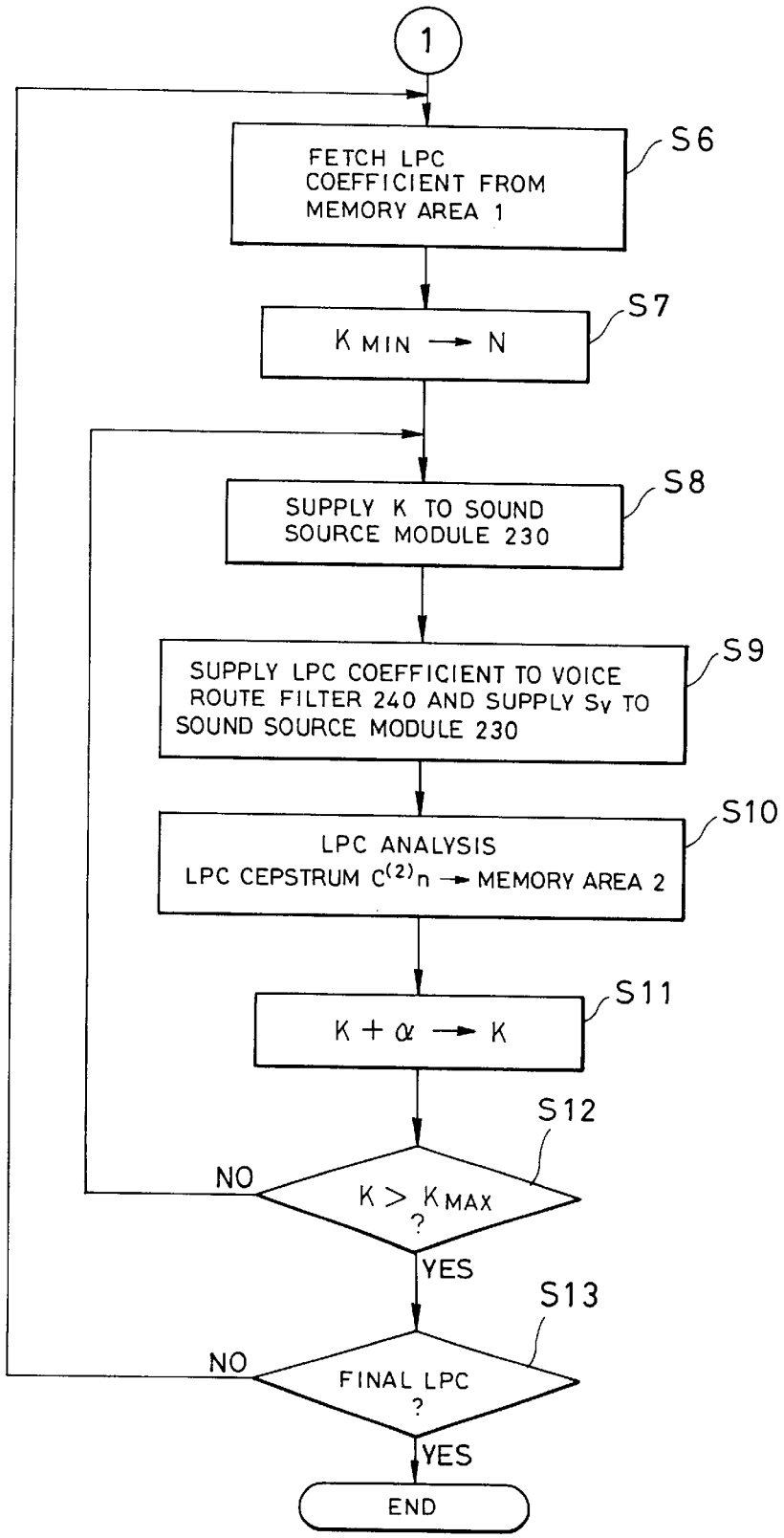
FIG. 5 is a diagram showing the forming procedure of optimum phoneme data based on the phoneme data forming method according to the invention.
Figure 6:
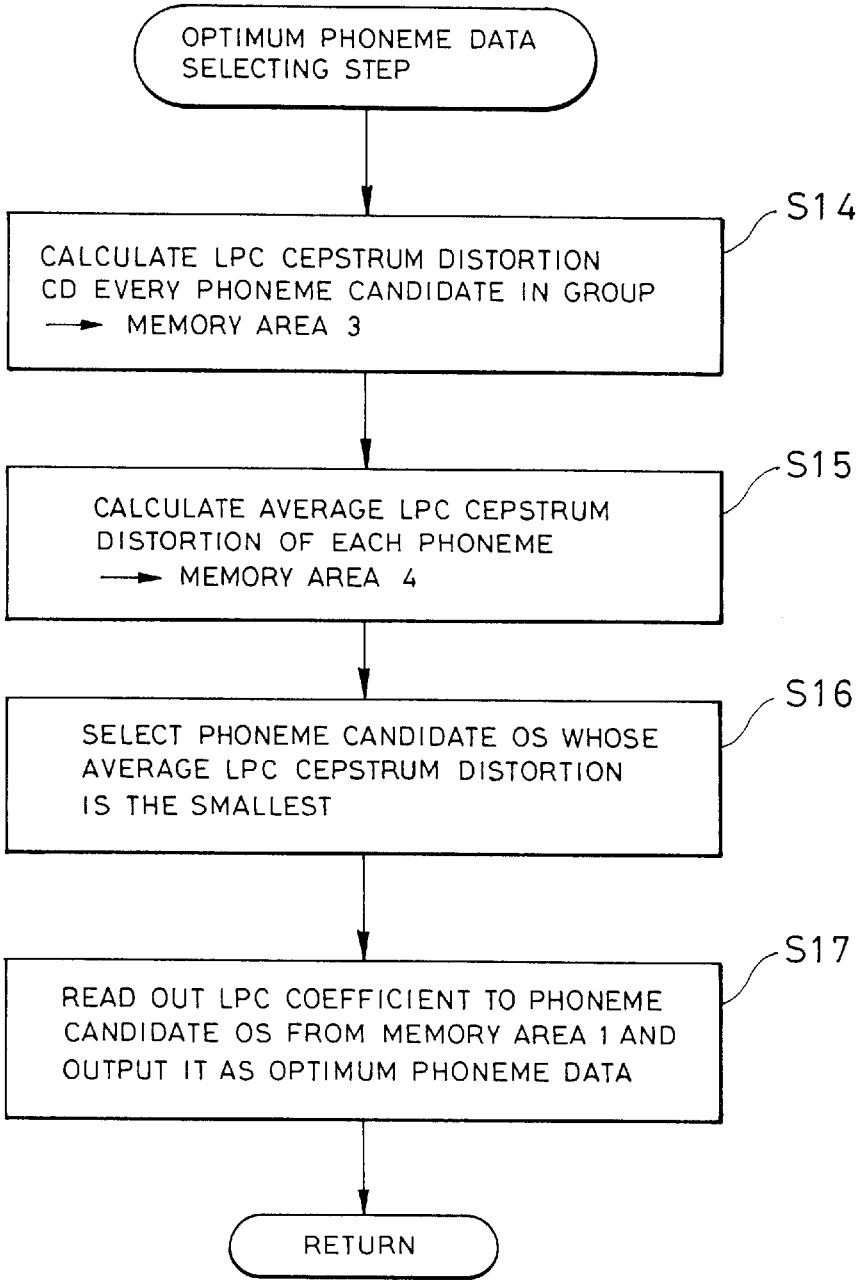
FIG. 6 is a diagram showing the procedure for forming optimum phoneme data based on the phoneme data forming method according to the invention.

FIGS. 4 to 6 are diagrams showing a procedure for forming the optimum phoneme data which is executed by the phoneme data forming apparatus 30 and based on the invention.

First, the phoneme data forming apparatus 30 executes LPC analyzing steps as shown in FIGS. 4 and 5.

In FIG. 4, the phoneme data forming apparatus 30 reads out each of the voice samples stored in the memory 33 and divides the voice sample into phonemes "VCV" based on the voice sample waveform (step S1).

For example, a voice sample "mokutekitini" is divided into the following phonemes.

mo/oku/ute/eki/iti/ini/i

A voice sample "moyooshimonono" is divided into the following phonemes.

mo/oyo/osi/imo/ono/ono/o

A voice sample "moyorino" is divided into the following phonemes.

mo/oyo/ori/ino/o

A voice sample "mokuhyouno" is divided into the following phonemes.

mo/oku/uhyo/ono/o

The phoneme data forming apparatus 30 subsequently divides each of the divided phonemes into frames of a predetermined length, for example, every 10 [msec] (step S2), adds management information such as the name of the phoneme to which the frame belongs, frame length of the phoneme, frame number, and the like to each of the divided frames, and stores the resultant frames into predetermined areas in the memory 33 (step S3).

Figure 7:
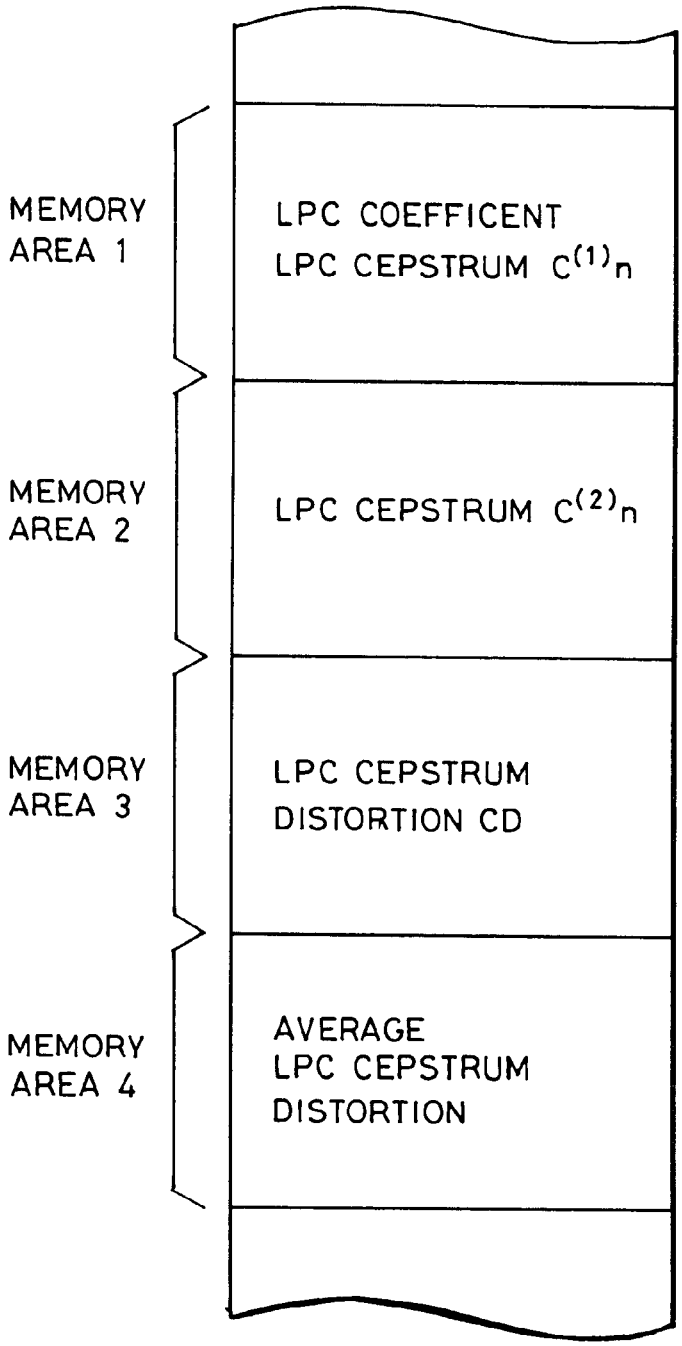
FIG. 7 is a diagram showing a part of a memory map in a memory 33.

The phoneme data forming apparatus 30 subsequently performs a linear predictive coding (what is called LPC) analysis to each of the phonemes of each of the frames divided in step S1, obtains linear predictive coding coefficients (hereinafter, referred to as LPC coefficients) as many as, for example, first to 15th orders, and stores the coefficients in a memory area 1 in the memory 33 as shown in FIG. 7 (step S4). The LPC coefficients obtained in step S4 are what are called voice spectrum envelope parameters corresponding to filter coefficients of the voice route filter 24 and are temporary phoneme data to be stored in the phoneme data memory 20. The phoneme data forming apparatus 30 subsequently obtains an LPC Cepstrum corresponding to each of the LPC coefficients obtained in step S4 and stores the LPC Cepstrum as an LPC Cepstrum $C^{(1)}{}_n$ in the memory area 1 in the memory 33 as shown in FIG. 7 (step S5).

Subsequently, the phoneme data forming apparatus 30 reads out one of a plurality of LPC coefficients stored in the memory area 1 and retrieves the LPC coefficient (step S6). The phoneme data forming apparatus 30 subsequently stores a lowest frequency $K_{MIN}$ which can be set as a pitch frequency, for example, 50 [Hz] in a built-in register K (not shown) (step S7). The phoneme data forming apparatus 30 subsequently reads out the value stored in the register K and supplies the value as a pitch frequency designation signal K to the sound source module 230 (step S8). The phoneme data forming apparatus 30 subsequently supplies the LPC coefficient retrieved by the execution of step S6 to the voice route filter 240 shown in FIG. 3 and supplies the sound source selection signal $S_V$ corresponding to the LPC coefficient to the sound source module 230 (step S9).

By the execution of steps S8 and S9, the voice waveform signal obtained when the phonemes of one frame are uttered at a sound pitch corresponding to the pitch frequency designation signal K is generated from the voice route filter 240 in FIG. 3 as a voice waveform signal $V_{AUD}$.

The phoneme data forming apparatus 30 obtains the LPC coefficient by performing an LPC analysis to the voice waveform signal $V_{AUD}$ and stores the LPC Cepstrum based on the LPC coefficient as an LPC Cepstrum $C^{(2)}{}_n$ in a memory area 2 in the memory 33 as shown in FIG. 7 (step S10). The phoneme data forming apparatus 30 subsequently rewrites the contents in the register K at the frequency obtained by adding a predetermined frequency $\alpha$, for example, 10 [Hz] to the contents stored in the register K (step S11). The phoneme data forming apparatus 30 subsequently discriminates whether the contents stored in the register K indicate a frequency higher than a maximum frequency $K_{MAX}$ which can be set as a pitch frequency, for example, 500 [Hz] or not (step S12). If it is determined in step S12 that the contents stored in the register K indicate the frequency that is not higher than the maximum frequency $K_{MAX}$, the phoneme data forming apparatus 30 is returned to the execution of step S8 and repetitively executes a series of operations as mentioned above.

That is, in steps S8 to S12, while the pitch frequency is first changed by the predetermined frequency a in a range of the frequencies $K_{MIN}$ to $K_{MAX}$, a voice synthesis based on the LPC coefficient read out from the memory area 1 is performed. The LPC analysis is performed on each voice waveform signal $V_{AUD}$ at each pitch frequency obtained by the voice synthesis, R LPC Cepstrums $C^{(2)}{}_{n1}$ to $C^{(2)}{}_{nR}$ at each pitch frequency as shown in FIG. 8 are obtained, respectively, and LPC Cepstrums $C^{(2)}{}_{n1}$ to $C^{(2)}{}_{nR}$ are sequentially stored in the memory area 2 in the memory 33.

If it is determined in step S12 that the contents stored in the built-in register K indicate a frequency higher than the maximum frequency $K_{MAX}$, the phoneme data forming apparatus 30 discriminates whether the LPC coefficient retrieved in step S6 is the last LPC coefficient among the LPC coefficients stored in the memory area 1 or not (step S13). If it is determined in step S13 that the read-out LPC coefficient is not the last LPC coefficient, the phoneme data forming apparatus 30 is returned to the execution of step S6. That is, the next LPC coefficient is read out from the memory area 1 in the memory 33 and a series of processes in steps S8 to S12 is again repetitively executed to the new read-out LPC coefficient. Each of the LPC Cepstrums $C^{(2)}{}_{n1}$ to $C^{(2)}{}_{nR}$ at each pitch frequency as shown in FIG. 8 obtained when the voice synthesizing process based on the new read-out LPC coefficient is executed is, consequently, additionally stored in the memory area 2 in the memory 33.

If it is determined in step S13 that the read-out LPC coefficient is the last LPC coefficient, the phoneme data forming apparatus 30 finishes the LPC analyzing step as shown in FIGS. 4 and 5.

By executing the following processes to the voices having the same phoneme name, the phoneme data forming apparatus 30 selects the optimum phoneme data in this phoneme.

A processing procedure will be described hereinbelow as an example with reference to FIG. 6 with respect to a case where phonemes having the phoneme name "mo" is used as targets.

It is assumed that 11 kinds of phonemes corresponding to "mo" as shown in FIG. 9 are obtained.

When executing the process shown in FIG. 6, the phoneme data forming apparatus 30 classifies the frame lengths of 11 kinds of phonemes corresponding to the phoneme "mo" into six kinds of ranges as shown in FIG. 10 with reference to the management information stored in a predetermined area in the memory 33 and classifies the phonemes of the frame lengths belonging to the same range into six groups. Each of the six kinds of ranges has a form in which it includes the other ranges as shown in FIG. 10. This arrangement is devised for enabling the acquisition of phoneme data corresponding to a phoneme having the frame length which could not be obtained from the utterance of the voice sample target person. For example, although the phoneme of the frame length "14" does not exist with respect to "mo" as shown in FIG. 9 obtained from the utterance of the voice sample target person, according to the grouping process as shown in FIG. 10, the phonemes corresponding to the frame length "14" as a representative phoneme length can be mentioned as candidates of the phoneme data. Although a plurality of phonemes whose frame lengths are equal to "13, 12, 10" exist in the group 2 in which the representative phoneme length is equal to "14" in the example of FIG. 10, the optimum phoneme is selected as a representative phoneme length "14". In the case of actually performing the voice synthesis, it is necessary to supplement the voice data by expanding the frame (for example, assuming that the optimum phoneme is the phoneme of 13 frames, 14 frames are short by only one frame). In the case of the invention, the frame at the end of the original phoneme data is repetitively used in order to minimize an influence of a distortion by the expansion of the phoneme. It is considered that the expansion of the phoneme length of up to 30% cannot be auditorily distinguished. According to this phenomenon, for example, the phoneme of the frame length "10" can be expanded up to the frame length "13". In this case, the 11th, 12th, and 13th frames are the same as the 10th frame.

The phoneme data forming apparatus 30 executes the optimum phoneme data selecting step shown in FIG. 6 in order to select the optimum phoneme data for each of the six groups as shown in FIG. 10.

In the example shown in FIG. 6, there is illustrated a processing procedure for obtaining the optimum phoneme data from the group 2 in FIG. 10.

In FIG. 6, the phoneme data forming apparatus 30 first obtains the LPC Cepstrum distortions of every candidates of the phonemes belonging to the group 2, namely, the phoneme candidates shown by the phoneme Nos. 2 to 4, 6, 7, and 10 in FIG. 9 and sequentially stores the phoneme candidates in a memory area 3 in the memory 33 as shown in FIG. 7 (step S14).

For example, for obtaining the LPC Cepstrum distortions from the phonemes corresponding to the phoneme No. 4, the phoneme data forming apparatus 30 first reads out all of the LPC Cepstrums $C^{(1)}_n$ corresponding to the phonemes of the phoneme No. 4 from the memory area 1 in FIG. 7 and further reads out all of the LPC Cepstrums $C^{(2)}_n$ corresponding to the phonemes of the phoneme No. 4 from the memory area 2. In this instance, since the phoneme of the phoneme No. 4 is constructed by 10 frame lengths as shown in FIG. 9, as for each of the LPC Cepstrums $C^{(1)}_n$ and $C^{(2)}_n$, the LPC Cepstrums of the number corresponding to the frame lengths are read out.

The phoneme data forming apparatus 30 subsequently executes the following arithmetic operations with respect to the LPC Cepstrums belonging to the same frame among the LPC Cepstrums $C^{(1)}_n$ and $C^{(2)}_n$ read out as mentioned above, thereby obtaining an LPC Cepstrum distortion CD.

$$CD = (10/ln10)\cdot\sqrt{\left\{2\cdot\sum_{n=1}^{N}(C_n^{(1)}-C_n^{(2)})^2\right\}}$$

where, n represents LPC Cepstrum degree

That is, the value corresponding to an error between the LPC Cepstrums $C^{(1)}_n$ and the LPC Cepstrums $C^{(2)}_n$ is obtained as an LPC Cepstrum distortion CD.

With respect to the LPC Cepstrums $C^{(2)}_n$, as shown in FIG. 9, R LPC Cepstrums as shown at $C^{(2)}_{n1}$ to $C^{(2)}_{nR}$ exist at every pitch frequency for one frame. The LPC Cepstrum distortions CD as many as the R LPC Cepstrums based on each of the LPC Cepstrums $C^{(2)}_{n1}$ to $C^{(2)}_{nR}$ are, therefore, obtained for one LPC Cepstrums $C^{(1)}_n$. That is, the LPC Cepstrum distortion according to each pitch frequency designation signal K is obtained.

The phoneme data forming apparatus 30 subsequently reads out each of the LPC Cepstrum distortions CD obtained from every phoneme candidate belonging to the group 2 from the memory area 3 shown in FIG. 7, obtains an average value of the LPC Cepstrum distortions CD for every phoneme candidate, and stores the distortions CD as an average LPC Cepstrum distortion in a memory area 4 in the memory 33 shown in FIG. 7 (step S15).

The phoneme data forming apparatus 30 subsequently reads out the average LPC Cepstrum distortion of each phoneme candidate from the memory area 4 and selects the phoneme candidate of the minimum average LPC Cepstrum distortion from the phoneme candidates belonging to the group 2, namely, from the phoneme candidates belonging to the representative phoneme length "14" (step S16). The minimum average LPC Cepstrum distortion denotes that even if any pitch frequency of the impulse signal which is used at the time of the voice synthesis is selected, an interference influence is the smallest.

The phoneme data forming apparatus 30 subsequently reads out the LPC coefficient corresponding to the phoneme candidate selected in step S16 from the memory area 1 shown in FIG. 7 and outputs the LPC coefficient as optimum phoneme data in the case where the frame length is "14" in the phoneme "mo" (step S17).

By similarly executing the processes in steps S14 to S17 even to each of the groups 1 and 3 to 6 shown in FIG. 10, each of the following phoneme data:

optimum phoneme data at the frame length "10"

optimum phoneme data at the frame length "11"

optimum phoneme data at the frame length "12"

optimum phoneme data at the frame length "13"

optimum phoneme data at the frame length "15" is selected from each of the groups 1 and 3 to 6 and the selected phoneme data are outputted from the phoneme data forming apparatus 30 as optimum phoneme data corresponding to the phoneme "mo". Only the phoneme data generated from the phoneme data forming apparatus 30 is finally stored in the phoneme data memory 20 shown in FIG. 1.

Although the optimum phoneme, namely, the phoneme of the smallest LPC Cepstrum distortion CD is stored from each group in the phoneme data memory 20 in the above example, if a capacity of the phoneme data memory is large, a plurality of, for example, three phoneme data can be also sequentially stored in the phoneme data memory 20 from the phoneme data of the smaller LPC Cepstrum distortion CD. In this case, by using the phoneme data which minimize the distortion between the adjacent phonemes at the time of voice synthesis, it is possible to allow the voice to further approach a natural voice.

According to the invention as described in detail above, first, the LPC coefficient is obtained every phoneme and used as temporary phoneme data and the first LPC Cepstrums $C^{(1)}_n$ based on the LPC coefficient are obtained. Subsequently, the pitch frequency is changed step by step with the filter characteristic of the voice synthesizing apparatus being set to the filter characteristic according to the temporary phoneme data, and the second LPC Cepstrums $C^{(2)}_n$ are obtained based on each voice waveform signal at every pitch frequency, which has been synthesized and outputted by the voice synthesizing apparatus. The first LPC Cepstrums $C^{(1)}_n$ and the second LPC Cepstrums $C^{(2)}_n$ are further obtained. The error between the first LPC Cepstrums $C^{(1)}_n$ and the second LPC Cepstrums $C^{(2)}_n$ is further obtained as a linear predictive coding Cepstrum distortion. The phonemes in the phoneme group belonging to the same phoneme name in each of the phonemes are classified into a plurality of groups at every frame length of the phoneme, the optimum phoneme is selected based on the linear predictive coding Cepstrum distortion for every group from this group, and the temporary phoneme data corresponding to the selected phoneme is selected as final phoneme data.

According to the invention, therefore, the phoneme data which is most difficult to be influenced by the pitch frequency is selected as phoneme data from the phoneme data corresponding to each of a plurality of phonemes having the same phoneme name. By performing the voice synthesis using the obtained phoneme data, therefore, the naturalness of the synthetic voice can be maintained irrespective of the pitch frequency at the time of synthesizing.

What is claimed is:

1. A method for forming phoneme data in a voice synthesizing apparatus for obtaining a voice waveform signal by filtering-processing a frequency signal by filter characteristics according to the phoneme data, comprising the steps of:

separating voice samples for every phoneme;

obtaining a linear predictive coding coefficient by performing a linear predictive coding analysis to said phoneme, setting said linear predictive coding coefficient to temporary phoneme data, obtaining a linear predictive coding Cepstrum based on said linear predictive coding coefficient, and setting said linear predictive coding Cepstrum as a first linear predictive coding Cepstrum;

obtaining a linear predictive coding Cepstrum by performing said linear predictive coding analysis to each of said voice waveform signals obtained by said voice synthesizing apparatus while changing a frequency of said frequency signal step by step, with a filter characteristic of said voice synthesizing apparatus being set to a filter characteristic according to said temporary phoneme data, and setting said linear predictive coding Cepstrum as a second linear predictive coding Cepstrum;

obtaining an error between said first linear predictive coding Cepstrum and said second linear predictive coding Cepstrum as a linear predictive coding Cepstrum distortion;

classifying each phoneme in a phoneme group belonging to a same phoneme name in each of said phonemes into a plurality of groups for every phoneme length; and selecting an optimum phoneme based on said linear predictive coding Cepstrum distortion from said group every said group and setting said temporary phoneme data corresponding to the selected phoneme to said phoneme data.

2. A method according to claim 1, wherein said optimum phoneme is a phoneme in which an average value of said linear predictive coding Cepstrum distortion obtained at every said frequency is small.

3. A method according to claim 1, wherein said frequency signal comprises a pulse signal indicative of a voice sound and a noise signal indicative of a voiceless sound.

4. A voice synthesizing apparatus comprising: a phoneme data memory in which a plurality of phoneme data corresponding to each of a plurality of phonemes has previously been stored; a sound source for generating frequency signals indicative of a voice sound and a voiceless sound; and a voice route filter for obtaining a voice waveform signal by filtering-processing said frequency signal based on filter characteristics according to said phoneme data, wherein a linear predictive coding coefficient is obtained by performing a linear predictive coding analysis to said phoneme and set to temporary phoneme data, a linear predictive coding Cepstrum based on said linear predictive coding coefficient is obtained and set as a first linear predictive coding Cepstrum, a linear predictive coding Cepstrum is obtained and set as a second linear predictive coding Cepstrum filter by performing said linear predictive coding analysis to each of said voice waveform signals obtained by said voice synthesizing apparatus, while a frequency of said frequency signal is changed step by step with a characteristic of said voice synthesizing apparatus being set to a filter characteristic according to said temporary phoneme data, an error between said first linear predictive coding Cepstrum and said second linear predictive coding Cepstrum is obtained as a linear predictive coding Cepstrum distortion, each phoneme in a phoneme group belonging to a same phoneme name in each of said phonemes is classified into a plurality of groups for every phoneme length, and each of said phoneme data is said temporary phoneme data corresponding to the optimum phoneme selected from said group based on said linear predictive coding Cepstrum distortion.

5. An apparatus according to claim 4, wherein said optimum phoneme is a phoneme in which an average value of said linear predictive coding Cepstrum distortion obtained at every said frequency is small.

* * * * *